US011730282B1

(12) United States Patent
Han

(10) Patent No.: US 11,730,282 B1
(45) Date of Patent: Aug. 22, 2023

(54) OUTDOOR FURNITURE COVER

(71) Applicant: WJ ETRADE LLC, NY, NY (US)

(72) Inventor: Joanna Han, NY, NY (US)

(73) Assignee: WJ ETRADE LLC, New York, NY (US)

( * ) Notice: Subject to any disclaimer, the term of this patent is extended or adjusted under 35 U.S.C. 154(b) by 0 days.

(21) Appl. No.: 18/082,528

(22) Filed: Dec. 15, 2022

(30) Foreign Application Priority Data

Nov. 8, 2022 (CN) ..... 202211392716.1
Nov. 8, 2022 (CN) ..... 202222984546.8

(51) Int. Cl.
*A47C 31/10* (2006.01)
*A47C 31/11* (2006.01)

(52) U.S. Cl.
CPC ..... *A47C 31/10* (2013.01); *A47C 31/105* (2013.01); *A47C 31/11* (2013.01)

(58) Field of Classification Search
CPC ..... A47C 31/10; A47C 31/105; A47C 31/11
USPC ..... 5/496, 497, 499, 737, 738; 297/219.1, 297/228.11
See application file for complete search history.

(56) References Cited

U.S. PATENT DOCUMENTS 2,161,448 A * 6/1939 Bishop ..... B60N 2/6027 D23/311
4,970,744 A * 11/1990 Davis ..... A47G 9/0246 5/497
5,020,177 A * 6/1991 Etherington ..... A47G 9/0246 5/497
5,046,207 A * 9/1991 Chamberlain ..... A47G 9/0246 5/497
5,333,921 A * 8/1994 Dinsmoor, III ..... A61G 5/1043 297/228.11
5,628,077 A * 5/1997 Briganti ..... A47G 9/0246 5/499
8,032,959 B2 * 10/2011 Rowson ..... A47G 9/02 5/498
8,074,313 B2 * 12/2011 Marcangelo ..... D05B 11/00 5/691
8,458,837 B2 * 6/2013 Marcangelo ..... A47C 31/00 5/691

(Continued)

FOREIGN PATENT DOCUMENTS

CN 115644641 A * 1/2023 ..... A47C 31/10

*Primary Examiner* — Robert G Santos

(57) ABSTRACT

The present invention discloses an outdoor furniture cover. It includes a cover main body and a channel arranged around the side of the cover main body for a full circle, a channel opening is arranged on the channel, and a tightening rope is arranged in the channel. The diameter of the channel is larger than the diameter of the tightening rope, and the tightening rope extends out from the channel opening. The channel opening is provided with a first sewed support element that partially blocks the channel opening. The first sewed support element is arranged below the tightening rope, and the tightening rope is tightened to drive the cover main body to tighten. The present invention has the following advantageous effects: it is ensured that the tightening rope will not rub against the bottom of the channel when the tightening rope is tightened; the tightening rope can be fully tightened, the interior space of the furniture cover is reduced, which reduces the wind force and has good wind proof effect.

7 Claims, 3 Drawing Sheets

(56) References Cited

U.S. PATENT DOCUMENTS

| | | | | |
|---|---|---|---|---|
| 8,607,383 | B2 * | 12/2013 | Briganti | A47G 9/0246 5/497 |
| 9,492,022 | B2 * | 11/2016 | Nekhala | A47G 9/0246 |
| 9,545,164 | B2 * | 1/2017 | Tulloch | A47G 9/0238 |
| 10,104,981 | B2 * | 10/2018 | Nekhala | A47G 9/0246 |
| 10,285,518 | B1 * | 5/2019 | Nekhala | A47G 9/0246 |
| 10,517,412 | B1 * | 12/2019 | Nekhala | A47G 9/0246 |
| 10,610,034 | B2 * | 4/2020 | Sturgeon | A47G 9/0292 |
| 2002/0116763 | A1 * | 8/2002 | Weir | A47G 9/0246 5/504.1 |
| 2008/0028522 | A1 * | 2/2008 | Atwood | A47G 9/0246 5/497 |
| 2008/0155749 | A1 * | 7/2008 | Stevens | A47G 9/0246 5/496 |
| 2008/0289104 | A1 * | 11/2008 | Rowson | A47G 9/02 5/923 |
| 2010/0269743 | A1 * | 10/2010 | Marcangelo | D05B 11/00 5/498 |
| 2011/0131724 | A1 * | 6/2011 | Marcangelo | D05B 11/00 5/498 |
| 2012/0324646 | A1 * | 12/2012 | Briganti | A47G 9/0246 5/496 |
| 2013/0088054 | A1 * | 4/2013 | Atchison | B60N 2/6027 297/228.11 |
| 2013/0254990 | A1 * | 10/2013 | Kim | A47G 9/0246 5/497 |
| 2014/0150181 | A1 * | 6/2014 | Tulloch | A47C 21/022 5/496 |
| 2016/0007774 | A1 * | 1/2016 | Kakabeeke | A47G 9/0246 5/496 |
| 2016/0174738 | A1 * | 6/2016 | Nekhala | A47G 9/04 24/72.5 |
| 2017/0035210 | A1 * | 2/2017 | Nekhala | A47G 9/0246 |
| 2018/0303256 | A1 * | 10/2018 | Sturgeon | A47C 21/028 |

* cited by examiner

OUTDOOR FURNITURE COVER

TECHNICAL FIELD OF THE INVENTION

The present invention relates to the technical field of furniture cover, specifically relates to an outdoor furniture cover.

BACKGROUND OF THE INVENTION

Outdoor furniture refers to a series of appliances set up in open or semi open outdoor space to facilitate people's outdoor leisure, rest or public outdoor activities compared with indoor furniture. Because it is very inconvenient to store and move furniture, which requires large storage space, users will choose to place outdoor furniture in outdoor space for a long time and protect it by using furniture covers with protective fabrics, so as to make it free from the interference and infringement of outdoor environmental factors, extend the service life of outdoor furniture, and keep it clean. The prior art discloses that a narrow channel is arranged on the furniture cover, and a tightening rope is arranged in the channel, the furniture cover is tightened through the tightening rope. However, the tightening rope will be close to the bottom of the channel under the action of gravity, and the tightening rope will have greater friction with the bottom of the channel, resulting in that the tightening rope cannot be fully tightened, the windproof effect is poor, which affects the user's use.

SUMMARY OF THE INVENTION

The present invention aims at providing an outdoor furniture cover. By providing a sewed support element at the opening of the channel, the sewed support element is provided below the tightening rope and supports the tightening rope to ensure that the tightening rope will not rub against the bottom of the channel when it is tightened. The tightening rope can be fully tightened, the interior space of the furniture cover is reduced, which plays a role in reducing the wind force and has good wind proof effect.

In order to realize the purpose of the present invention, the present invention provides the following technical solutions:

An outdoor furniture cover includes a cover main body, a channel arranged around the side of the cover main body for a full circle, a channel opening is arranged on the channel, and a tightening rope is arranged in the channel. The diameter of the channel is larger than the diameter of the tightening rope, and the tightening rope extends out from the channel opening. The channel opening is provided with a first sewed support element that partially blocks (or closes) the channel opening. The first sewed support element is arranged below the tightening rope, and the tightening rope is tightened to drive the cover main body to tighten.

Preferably, the channel opening is also provided with a second sewed support element that partially blocks the channel opening. The second sewed support element is arranged above the tightening rope. The second sewed support element can cover the upper part of the channel opening. The tightening rope will not contact and rub with the upper part of the channel opening when it is tightened, so as to prevent the tightening rope from sliding to the top of the channel and contacting and rubbing with the top of the channel when the user quickly tightens the tightening rope, otherwise users need to pay a large amount of pulling force to overcome the friction force to tighten the tightening rope, which may even cause the tightening rope to get stuck and cannot be fully tightened, affecting the use of the furniture cover.

Preferably, the extending out end of the tightening rope along the channel opening is provided with a tightening rope buckle. The area where the channel opening is not blocked by the first sewed support element is a movable opening. The diameter of the tightening rope buckle is larger than the movable opening, which can prevent the tightening rope buckle from sliding into the channel.

Preferably, the channel is provided with two channel openings, which are arranged diagonally, and the two channel openings are correspondingly provided with two tightening rope buckles. The two ends of the tightening rope are tightened together through two tightening rope buckles, and the extending out distance of the tightening rope is shortened, which can increase the neatness and beauty of the furniture cover.

Preferably, the bottom of the lower hem of the cover main body is also provided with more than two webbing belts and a tightening rope. The webbing belts are sewn on the cover main body, and the webbing belts are provided with grommets. The tightening rope passes through the grommets in turn. The tightening rope is tightened to drive the lower hem of the cover main body to tighten. The tightening rope drives the webbing belts to tighten by tightening the grommets, and indirectly tightens the lower hem of the cover main body. The grommets are not directly arranged on the furniture cover, so as to avoid damaging the surrounding fabric of the grommet when the tightening rope is tightened by force, and if the webbing belts are damaged, they can be sewn again without replacing the entire furniture cover, which can reduce the use loss of the tightening rope and save costs.

Preferably, the webbing belts are sewn on the inner side of the lower hem of the cover main body through multiple reinforcement sewing, the lower ends of the webbing belts do not exceed the lower hem of the cover main body, so that the webbing belts and the grommets will not be exposed on the front, and the inner tightening of the tightening rope is realized and the tightening rope is not exposed, which improves the overall beauty of the furniture cover.

Preferably, the bottom of the lower hem of the cover main body is also provided with a buckle, which includes a male buckle and a female buckle. The male buckle and the female buckle are fastened around and fixed on the furniture leg to play a certain wind proof fixing effect.

Compared with the prior art, the present invention has the following advantageous effects:

In the present invention, a channel is arranged around the side of the main body of the cover for a full circle, and a channel opening is arranged on the channel. The tightening rope passes through the channel and extends out from the channel opening. The diameter of the channel is larger than the diameter of the tightening rope, which can ensure that the tightening rope is separated from the bottom of the channel and they will not be directly contacted. In addition, the channel opening is provided with a first sewed support element, which is arranged below the tightening rope and partially blocks the lower part of the channel opening, so that when the tightening rope is pulled out from the channel opening, the tightening rope is supported by the first sewed support element, the direction of force subjected by the tightening rope is in the middle of the channel opening. The tightening rope in the channel will not sag to the bottom of the channel, which can avoid friction between the tightening rope and the bottom of the channel. The tightening rope can be fully tightened without paying a large pull, and the furniture cover can be fully tightened and close to the furniture, so that the interior space of the furniture cover is greatly reduced and it is not easy for outdoor wind to enter the furniture cover. The windproof effect of the furniture cover is improved and it is convenient for users to use.

Therefore, the present invention provides an outdoor furniture cover. By providing a sewed support element at the channel opening, the sewed support element is arranged below the tightening rope and supports the tightening rope, so as to ensure that the tightening rope will not rub with the bottom of the channel when the tightening rope is tightened. The tightening rope can be fully tightened, and the interior space of the furniture cover is reduced, which plays the role of reducing the wind force, and the wind proof effect is good.

DETAILED DESCRIPTION OF THE PREFERRED EMBODIMENT

Figure 1:
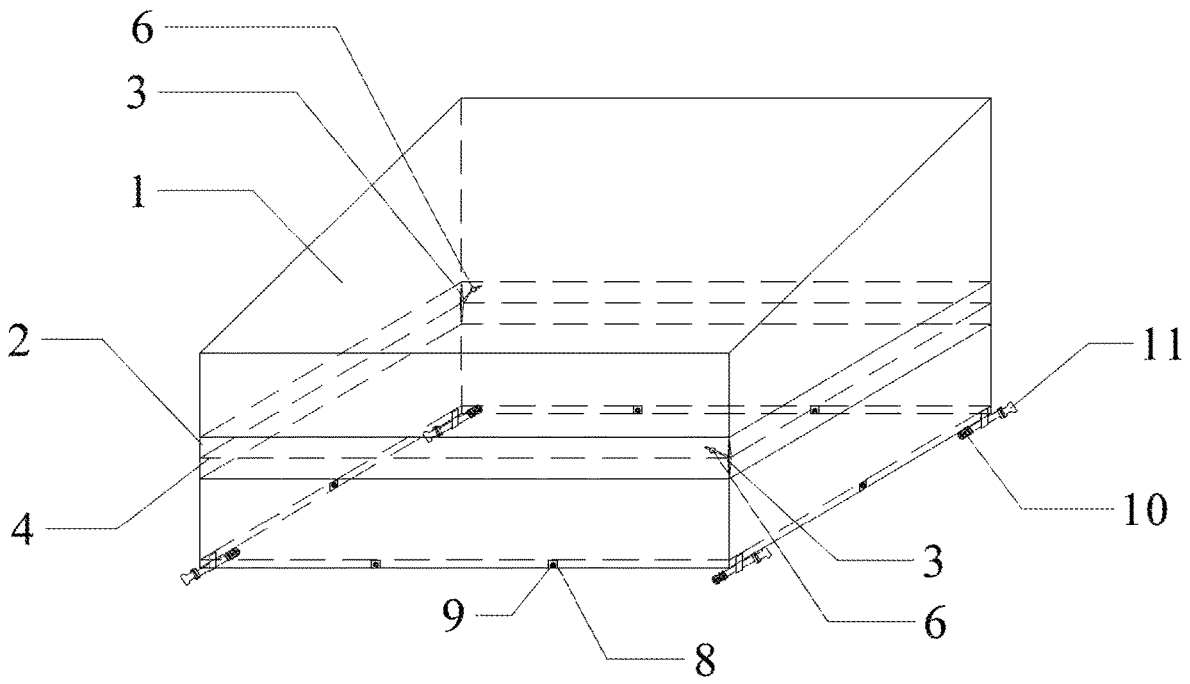
FIG. 1 is a perspective view of the overall structure of the present invention.

The technical solutions of the embodiments of the present invention will be clearly and entirely described below with the drawings of the embodiments of the present invention. Obviously, the described embodiments are just a part of the embodiments of the present invention, and are not all of them. All other embodiments that can be obtained by a person skilled in the art based on the embodiments of the present invention without any creative effort are included in the protection scope of the present invention.

It should be noted that, all the directional indications (such as up, down, left, right, front, rear . . . ) in the embodiments of the present invention are merely used for explaining the relative positional relationship and movement conditions and the like between each part under a certain posture (as shown in the drawings), if such a posture changes, then the directional indications are changed correspondingly.

In the present invention, such description involving "first" and "second" and the like are merely for the purpose of description, but cannot be understood as indicating or implying its relative importance or implicitly indicating the quantity of the indicated technical features. Therefore, the feature defined with "first" and "second" can explicitly or implicitly include at least one such feature; secondly, in the description of the present invention, "a plurality of" means at least two, for example, two, three and the like, unless otherwise specifically defined.

In the present invention, unless otherwise definitely prescribed and defined, the terms "connection", "connects", "connected", "fixed" and the like should be understood in its broad sense. For example, the "connection" may be a fixed connection, may also be a detachable connection or an integrated connection; may be a mechanical connection, may also be an electrical connection; and the "connected" may be directly connected and can also be indirectly connected through an intermediate medium, and can also be the internal communication inside two elements or an interaction relationship between two elements, unless otherwise definitely defined. The specific meaning of the above-mentioned terms in the present invention may be understood by those of ordinary skill in the art in light of specific circumstances.

In addition, the technical solutions between each embodiment in the present invention can be mutually combined, but should be on the basis that the technical solutions can be realized by those skilled in the art, when the combination of the technical solutions is contradictory or cannot be realized, it should be deemed that the combination of technical solutions does not exist and does not fall within the protection scope claimed by the present invention.

The present invention provides an outdoor furniture cover. The names of the components corresponding to the reference numerals in the figures are as follows: 1. cover main body; 2. channel; 3. channel opening; 4. tightening rope; 5. first sewed support element; 6. tightening rope buckle; 7. second sewed support element; 8. webbing belt; 9. grommet; 10. male buckle; 11. female buckle.

The outdoor furniture cover shown in FIG. 1 includes a cover main body 1, a channel 2 arranged around the side of the cover main body 1 for a full circle, a channel opening 3 is arranged on the channel 2, and a tightening rope 4 is arranged in the channel 2. The diameter of the channel 2 is larger than the diameter of the tightening rope 4, and the tightening rope 4 extends out from the channel opening 3. The channel opening 3 is provided with a first sewed support element 5 that partially blocks the channel opening 3. The first sewed support element 5 is arranged below the tightening rope 4, and the tightening rope 4 is tightened to drive the cover main body 1 to tighten.

The extending out end of the tightening rope 4 along the channel opening 3 is provided with a tightening rope buckle 6. The area where the channel opening 3 is not blocked by the first sewed support element 5 is a movable opening. The diameter of the tightening rope buckle 6 is larger than that of the movable opening, which can prevent the tightening rope buckle 6 from sliding into the channel 2.

The channel 2 is provided with two channel openings 3, which are arranged diagonally, and the two channel openings 3 are correspondingly provided with two tightening rope buckles 6. The two ends of the tightening rope 4 are tightened together through two tightening rope buckles 6, and the extending out distance of the tightening rope 4 is shortened, which can increase the neatness and beauty of the furniture cover.

Figure 2:
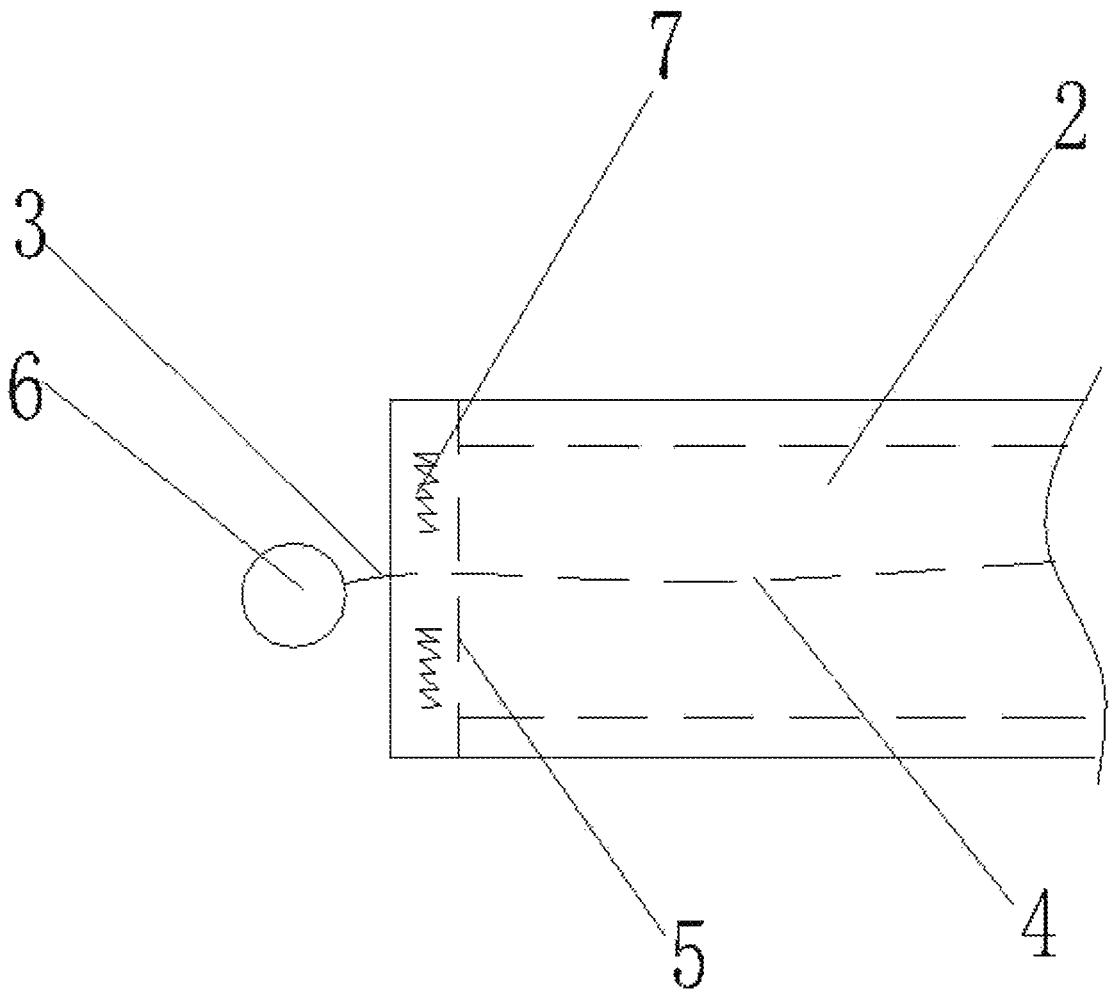
FIG. 2 is the structural perspective view of the channel opening in the present invention.

Embodiment 1 is shown in FIG. 2, wherein the outdoor furniture cover includes a cover main body 1, a channel 2 arranged around the side of the cover main body 1 for a full circle, a channel opening 3 is arranged on the channel 2, and a tightening rope 4 is arranged in the channel 2. The diameter of the channel 2 is larger than the diameter of the tightening rope 4. The channel opening 3 is provided with a first sewed support element 5 and a second sewed support element 7. The first sewed support element 5 is arranged below the tightening rope 4, and the second sewed support element 7 is arranged above the tightening rope 4

The use and working method of the embodiment 1 is as follows: the tightening rope 4 extends out from the channel opening 3; when the tightening rope 4 is tightened, the first sewed support element 5 covers the low part of the channel opening 3, the second sewed support element 7 covers the above part of the channel opening 3, the tightening rope 4 is limited in the middle of the channel opening 3. The direction of force subjected by the tightening rope 4 is in the middle of the tightening rope 4, so that the tightening rope 4 in the channel 2 will not receive an upward or downward component, and the tightening rope 4 in the channel 2 will not contact with the top or the bottom of the channel 2. The tightening rope 4 receives less friction in the channel 2, so the user can easily tighten the tightening rope 4 to tighten the furniture cover.

Embodiment 2 is shown in FIG. 1, wherein the outdoor furniture cover includes a cover main body 1, a channel 2 arranged around the side of the cover main body 1 for a full circle, a channel opening 3 is arranged on the channel 2, and a tightening rope 4 is arranged in the channel 2. The diameter of the channel 2 is larger than the diameter of the tightening rope 4. The bottom of the lower hem of the cover main body 1 is also provided with more than two webbing belts 8 and a tightening rope. The webbing belts 8 are sewn on the cover main body 1, and the webbing belts 8 are provided with grommets 9. The tightening rope passes through the grommets 9 in turn. The tightening rope is tightened to drive the lower hem of the cover main body 1 to tighten.

Figure 3:
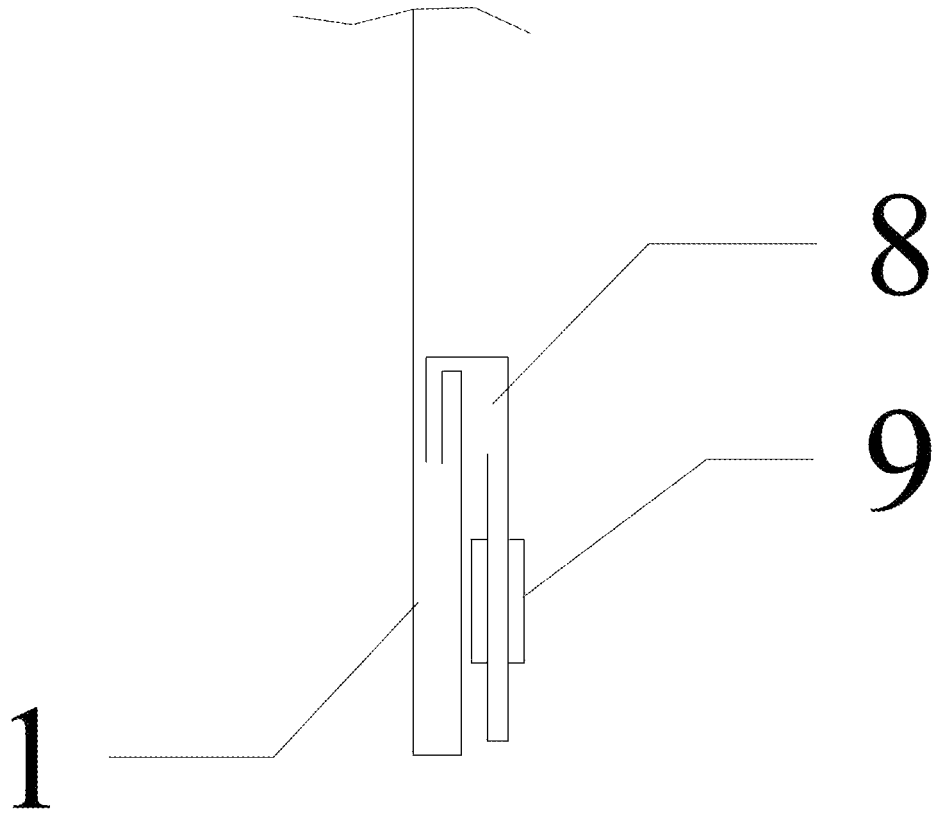
FIG. 3 is a schematic view of the installation structure of the webbing belts and the grommets in the present invention.

Furthermore, as shown in FIG. 3, the webbing belts 8 are sewn on the inner side of the lower hem of the cover main body 1 through multiple reinforcement sewing, the lower ends of the webbing belts 8 do not exceed the lower hem of the cover main body 1, so that the webbing belts 8 and the grommets 9 will not be exposed on the front, and the inner tightening of the tightening rope is realized and the tightening rope is not exposed, which improves the overall beauty of the furniture cover.

The use and working method of the embodiment 2 is as follows: the tightening rope 4 extends out from the channel opening 3; the tightening rope 4 is tightened, and the furniture cover is tightened towards the middle and close to the furniture. The interior space of the furniture cover is greatly reduced, and outdoor wind is not easy to enter the furniture cover. The tightening rope drives the webbing belts 8 to tighten by tightening the grommets 9, and indirectly tightens the lower hem of the cover main body 1. The grommets 9 are not directly arranged on the furniture cover, so as to avoid damaging the surrounding fabric of the grommets 9 when the tightening rope is tightened by force, and if the webbing belts 8 are damaged, they can be sewn again without replacing the entire furniture cover, which can reduce the use loss of the tightening rope and save costs.

Embodiment 3 is shown in FIG. 1, wherein the outdoor furniture cover includes a cover main body 1, a channel 2 arranged around the side of the cover main body 1 for a full circle, a channel opening 3 is arranged on the channel 2, and a tightening rope 4 is arranged in the channel 2. The diameter of the channel 2 is larger than the diameter of the tightening rope 4. The bottom of the lower hem of the cover main body 1 is also provided with a buckle, which includes a male buckle 10 and a female buckle 11.

The use and working method of the embodiment 3 is as follows: the tightening rope 4 extends out from the channel opening 3; the tightening rope 4 is tightened, and the furniture cover is tightened towards the middle and close to the furniture. The interior space of the furniture cover is greatly reduced, and outdoor wind is not easy to enter the furniture cover. The male buckle 10 and the female buckle 11 are circularly fastened and fixed on the furniture leg to play a certain wind proof fixing effect.

Compared with the prior art, the present invention has the following advantageous effects:

In the present invention, a channel 2 is arranged around the side of the cover main body 1 for a full circle, and a channel opening 3 is arranged on the channel 2. The tightening rope 4 passes through the channel 2 and extends out from the channel opening 3. The diameter of the channel 2 is larger than the diameter of the tightening rope 4, which can ensure that the tightening rope 4 is separated from the bottom of the channel 2 and they will not be directly contacted. In addition, the channel opening 3 is provided with a first sewed support element 5, which is arranged below the tightening rope 4 and partially blocks the lower part of the channel opening 3, so that when the tightening rope 4 is pulled out from the channel opening 3, the tightening rope 4 is supported by the first sewed support element 5, the direction of force subjected by the tightening rope 4 is in the middle of the channel opening 3. The tightening rope 4 in the channel 2 will not sag to the bottom of the channel 2, which can avoid friction between the tightening rope 4 and the bottom of the channel 2. The tightening rope can be fully tightened without paying a large pull, and the furniture cover can be fully tightened and close to the furniture, so that the interior space of the furniture cover is greatly reduced and it is not easy for outdoor wind to enter the furniture cover. The windproof effect of the furniture cover is improved and it is convenient for users to use.

Therefore, the present invention provides an outdoor furniture cover. By providing a sewed support element at the channel opening 3, the sewed support element is arranged below the tightening rope 4 and supports the tightening rope 4, so as to ensure that the tightening rope 4 will not rub with the bottom of the channel 2 when the tightening rope 4 is tightened. The tightening rope can be fully tightened, and the interior space of the furniture cover is reduced, which plays the role of reducing the wind force, and the wind proof effect is good.

The above described embodiments are only the preferred embodiments of the present invention. It should be noted that, the present invention is not limited to the above preferred embodiments, and the protection scope of the present invention is defined by the claims. For a person skilled in the art, on the premise of not departing away from the spirit and scope of the present invention, several improvements and modifications may also be made, and such improvements and modifications are also deemed to be within the protection scope of the present invention.

The invention claimed is:

1. An outdoor furniture cover, characterized in that it includes a cover main body and a channel arranged around the side of the cover main body for a full circle, a channel opening is arranged on the channel, and a tightening rope is arranged in the channel, the diameter of the channel is larger than the diameter of the tightening rope, and the tightening rope extends out from the channel opening, the channel opening is provided with a first sewed support element that partially blocks the channel opening, the first sewed support element is arranged below the tightening rope, and the tightening rope is tightened to drive the cover main body to tighten.

2. The outdoor furniture cover according to claim 1, characterized in that the channel opening is also provided with a second sewed support element that partially blocks the channel opening, the second sewed support element is arranged above the tightening rope.

3. The outdoor furniture cover according to claim 1, characterized in that an extending out end of the tightening rope along the channel opening is provided with a tightening rope buckle, the area where the channel opening is not blocked by the first sewed support element is a movable opening, and the diameter of the tightening rope buckle is larger than the movable opening.

4. The outdoor furniture cover according to claim 1, characterized in that the channel is provided with two channel openings, which are arranged diagonally.

5. The outdoor furniture cover according to claim 1, characterized in that the bottom of a lower hem of the cover main body is also provided with more than two webbing belts and a tightening rope, the webbing belts are sewn on the cover main body, and the webbing belts are provided with grommets, the tightening rope passes through the grommets in turn, and the tightening rope is tightened to drive the lower hem of the cover main body to tighten.

6. The outdoor furniture cover according to claim 5, characterized in that the webbing belts are sewn on the inner side of the lower hem of the cover main body through multiple reinforcement sewing, and lower ends of the webbing belts do not exceed the lower hem of the cover main body.

7. The outdoor furniture cover according to claim 1, characterized in that the bottom of a lower hem of the cover main body is also provided with a buckle, which includes a male buckle and a female buckle, and the male buckle and the female buckle are fastened around a furniture leg and fixed on the furniture leg.

* * * * *